United States Patent [19]

Sabin

[11] Patent Number: 4,793,798

[45] Date of Patent: Dec. 27, 1988

[54] BURNER APPARATUS

[76] Inventor: Darrel B. Sabin, 2800 N. First St., Martin, Ohio 43445

[21] Appl. No.: 7,005

[22] Filed: Jan. 27, 1987

Related U.S. Application Data

[63] Continuation-in-part of Ser. No. 894,795, Aug. 8, 1986, abandoned.

[51] Int. Cl.[4] ..... F23N 1/02

[52] U.S. Cl. ..... 431/90; 431/187; 431/281; 431/284; 239/562

[58] Field of Search ..... 431/12, 89, 90, 174, 431/187, 281, 284; 137/100; 239/416.4, 562, 456, 459

[56] References Cited

U.S. PATENT DOCUMENTS

| | | | |
|---|---|---|---|
| 1,716,325 | 6/1929 | Rogers | 431/89 |
| 1,781,236 | 11/1930 | Lilge | 431/352 |
| 2,296,255 | 9/1942 | Bloom | 236/15 |
| 2,303,925 | 12/1942 | Fisher . | |
| 2,364,299 | 12/1944 | Kester . | |
| 2,800,915 | 7/1957 | Tavener | 137/88 |
| 2,838,106 | 6/1958 | Thomas | 431/90 |
| 3,315,726 | 4/1967 | Williams | 431/89 |
| 3,371,699 | 3/1968 | Riot | 431/90 |
| 3,753,642 | 8/1973 | Lamoureux | 431/89 |
| 3,771,944 | 11/1973 | Hovis et al. | 431/284 |
| 3,782,881 | 1/1974 | Feeney | 431/90 |
| 4,097,219 | 6/1978 | Prowald | 431/90 |
| 4,385,887 | 5/1983 | Yamamoto et al. | 431/90 |
| 4,465,456 | 8/1984 | Hynek et al. | 431/62 |
| 4,640,678 | 2/1987 | Fraioli | 431/75 |
| 4,652,234 | 3/1987 | Voorheis | 431/281 |

FOREIGN PATENT DOCUMENTS

| | | | |
|---|---|---|---|
| 711120 | 9/1931 | France | 431/90 |
| 0105611 | 7/1982 | Japan | 431/350 |

*Primary Examiner*—Margaret A. Focarino
*Attorney, Agent, or Firm*—Emch, Schaffer, Schaub & Porcello Co.

[57] ABSTRACT

An improved nozzle-mixing burner apparatus is disclosed. Combustion air pressure is sensed at a control which is connected to a drive rod. Movement of the drive rod opens or closes fuel and air nozzle valves to maintain the ratio of combustion air and fuel over a wide range of flow rate.

14 Claims, 4 Drawing Sheets

BURNER APPARATUS

RELATED APPLICATIONS

This application is a continuation-in-part of my U.S. application Ser. No. 894,795 filed Aug. 8, 1986, now abandoned.

BACKGROUND OF THE INVENTION

By far, the most common means of supplying heat for industrial use is by gas burners. The great majority of these burners are nozzle-mixing burners; that is, fuel gas and combustion air are piped separately to the burner and mixed, for combustion, at the burner nozzle or nozzles. The other type of burner is commonly called a pre-mix burner; combustion air and fuel gas are mixed prior to reaching this type of burner and are ignited at the burner discharge. This invention relates to nozzle-mixing burners.

Industrial burners may be used to heat furnaces, ovens, or other devices or process. In this specification, the word furnace will be used to include all furnaces, ovens, other devices and processes.

Generally, combustion air is supplied to the furnace burners by means of an electrically-driven combustion air blower. At most installations, fuel gas is supplied at an adequate pressure, so that no fuel gas pump or blower is required. In many cases, a multiplicity of burners are connected by common combustion air and fuel gas lines. The most common means of controlling the firing rate of the burner or burners is by controlling the flow of combustion air to the burner or burners, in response to the output of a temperature controller. Varying combustion air flow rates result in varying combustion air static pressures. In order to maintain a pre-determined air/fuel ratio, the fuel gas flow rate is held proportional to the combustion air flow rate, usually by using a regulator in the fuel gas line to maintain the fuel gas static pressure equal to, or proportional to, the combustion air static pressure.

Many other means are used to control air/fuel ratios to burners, including electronic mass flow metering and control systems.

Regardless of the type of burner control system, a common problem encountered in industrial heating applications, where modulated burner input is desired, is the inability, with existing burners, to reduce the total input to the furnace far enough while maintaining the desired air/fuel ratio.

In the industrial heating industry, turndown is the term used to indicate the ratio of the maximum firing rate capability of a burner to its minimum firing rate capability, while maintaining a constant air to fuel ratio. Typically, a nozzle-mixing burner is rated as capable of achieving a turndown of 10 to 1; that is, its minimum firing rate is one-tenth of its maximum firing rate.

In actual practice, turndown is often limited to about 7 to 1 because of the difficulty in controlling the low combustion air and fuel gas static pressures required for very low inputs, particularly the fuel gas static pressure. Where several burners are manifolded together, the very low static pressure result in problems in distributing, evenly, combustion air and fuel gas to the burners comprising the manifold.

For example, if the combustion air static pressure at maximum firing rate were, say, 16 ounces per square inch, the static pressure would be 0.16 ounces per square inch when the firing rate was one-tenth of the maximum firing rate. It is difficult to control fuel gas pressures and distribution at such low pressures. Additionally, at very low static pressures the velocity of the combustion air and fuel gas exiting the burner may become so low that the flame propagation rate exceeds the air and fuel gas velocities.

Further, in many industrial heating applications it would be very desirable to be able to utilize burners that would have turndown capabilities of greater than 7 to 1 or 10 to 1, while firing at constant air/fuel ratios. In many batch type furnaces, for example, a high firing rate is desirable to minimize heating times but very low (relative) inputs are required to prevent over-heating when the furnace and the work in the furnace reach the desired maximum temperature, while the work is "soaking". In some cases, it would be desirable to utilize burners having turndown capabilities of, perhaps, 50 to 1. A 50 to 1 turndown in conventional burners, however, would require the combustion air and fuel gas static pressures to be reduce to 50 squared, or 1/2500 of the static pressures at maximum firing rate. In the case cited above, using combustion air static pressure of 16 ounces per square inch at maximum firing rate, the combustion air static pressure at the minimum firing rate would be 0.0064 ounces per square inch.

When burner turndown requirements exceed burner capabilities in current industrial practice, one of five methods is usually used to overcome the burner limitations. The five methods are:

(a) Firing the burners on-off.

The disadvantage of this type of system is that with many processes the temperature cycling that results is undesirable or unacceptable.

(b) Increasing the air/fuel ratio as burner firing rate decreases, thus increasing the effective burner turndown.

This type of system results in greatly increased fuel costs.

(c) Modulating the burner firing rate over the range of the burner turndown achievable and then holding the combustion air flow rate constant while decreasing fuel gas flow rate.

This type of system results in increased fuel costs, although it is more efficient that the system described in b. This system also requires additional controls.

(d) Turning some burners off manually.

This not only requires operator control of burners but also results in reduced furnace uniformity.

(e) Cycling different burners on and off at a rate determined by the heat input required to the furnace.

This is a complicated and expensive system known as the "pulse" system. Aside from the cost disadvantage, many processes suffer when alternate burners are cycled on and off.

SUMMARY OF THE INVENTION

My invention is a type of nozzle-mixing burner apparatus that is capable of high turndown rates while maintaining constant air/fuel ratios.

Further, my burner apparatus is a constant-velocity burner; that is, the pressure drop of the burner on both the combustion air and fuel gas sections is essentially constant from the maximum input to minimum input.

The constant-velocity, constant-pressure-drop characteristics of my burner apparatus also overcome the problem of low combustion air and fuel gas velocities at very low firing rates.

These and other objects, features, and advantages of the present invention will become more obvious when taken in connection with the accompanying drawings which show, for purposes of illustration only, three embodiments in accordance with the present invention.

DETAILED DESCRIPTIONS OF THE ILLUSTRATED EMBODIMENTS

Figure 1:
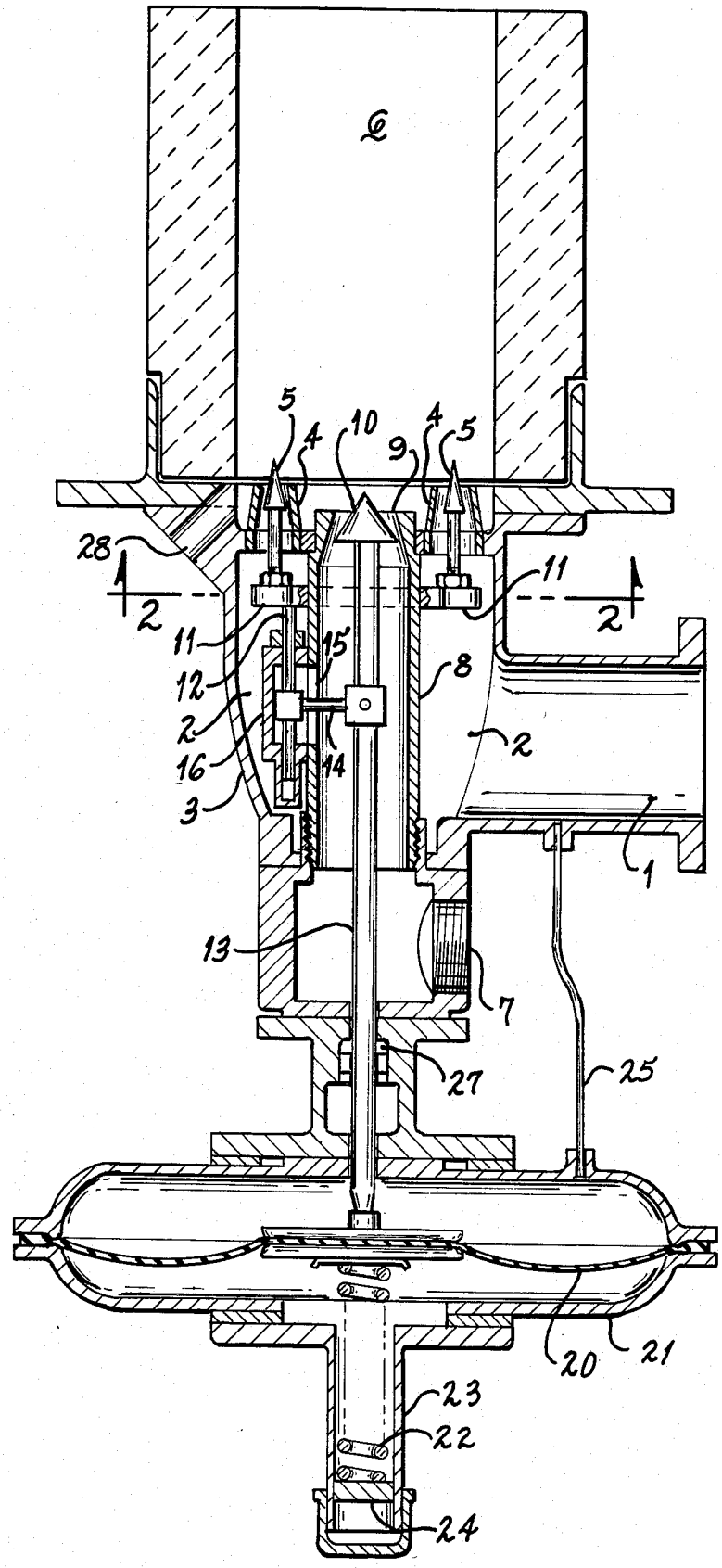
FIG. 1 is a cross-sectional view through the center of a constant-velocity burner in accordance with the present invention, in which certain details are not shown, and in which some devices as shown out of rotational position, for the purpose of clairity.
Figure 3:
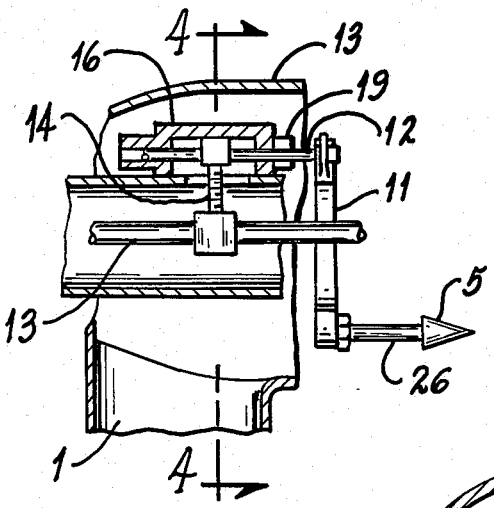
FIG. 3 is a cross-section view taken along line III—III of FIG. 2.
Figure 2:
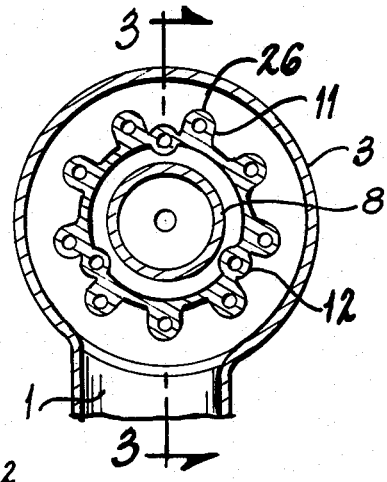
FIG. 2 is a cross-section view taken along line II—II of FIG. 1.
Figure 6:
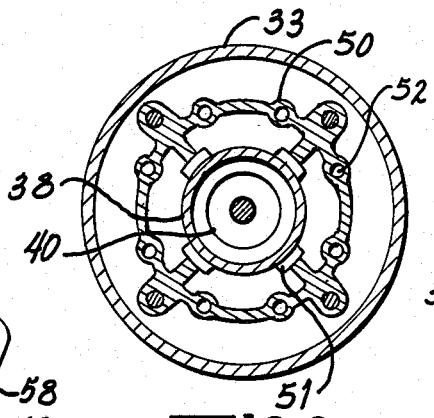
FIG. 6 is a cross-section view taken along line VI—VI of FIG. 5.

Referring now to the drawings wherein like reference numerals are used throughout the various sections to designate corresponding parts, and more particularly to FIG. 1, reference numeral 1 designates the inlet port or conduit for combustion air. The combustion air flows in the annular space 2, formed on the outside by the burner housing 3 and on the inside by the gas tube 8, toward frusto-conical nozzle valve ports 4. Combustion air then flows past the nozzle valve plugs 5 and into the refractory combustion chamber 6.

Fuel gas enters the burner via the inlet port 7 and flows inside the gas tube 8; passes through the gas nozzle valve port 9 and gas nozzle valve plug 10 into the combustion chamber 6.

The combustion air nozzle valve plugs 4 are fastened to a connector plate 11 via valve plug shafts 26. Connector plate 11 is supported by and moved horizontally by three connecting rods 12. The connecting rods 12 are, in turn, fastened to the main drive rod 13 by intermediate rods 14. The intermediate rods 14 are free to move horizontally within slots 15 in the gas tube 8.

Figure 4:
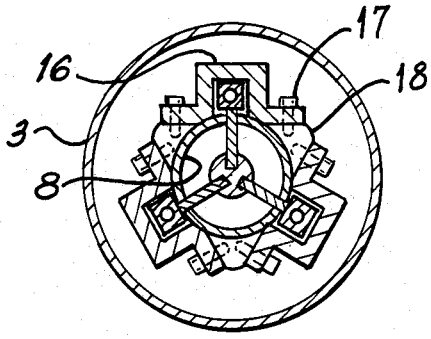
FIG. 4 is a cross-section view taken along line IV—IV of FIG. 3.
Figure 7:
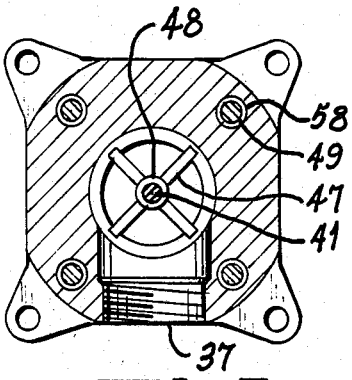
FIG. 7 is a cross-section view taken along line VII—VII of FIG. 5.

Seal housings 16 (see FIG. 4) serve to isolate the fuel gas in the gas tube 8 from the combination air in the annual passage 2, while permitting the horizontal movement of the connecting rods 12. The seal housings 16 are sealed to the gas tube 8 by the pressure of the bolts 17 threaded into bosses 18 which are, in turn, fastened to the gas tube 8. The connecting rods 12 slide horizontally through sliding shaft seals 19.

The horizontal motion of the diaphragm 20 causes the main drive rod 13, the intermediate rods 14, the connecting rods 12, the connecting plate 11, the combustion air nozzle valve plugs 5, and the fuel gas nozzle valve plug 10 to also move horizontally.

The diaphragm 20 is retained in the diaphragm housing 21. The left side of the diaphragm 20 is loaded by the compression spring 22, retained in an outwardly extending housing 23. The compressive force of the spring 22 is adjusted by a threaded nut 24. The right side of the diaphragm 20 is loaded by a line or conduit 25 extending from the combustion air inlet pipe 1.

A shaft seal 27 serves to prevent loading combustion air on the right side of the diaphragm 20 from leaking into the fuel gas tube 8. Leakage would be in the direction indicated, since combustion air pressure will normally be higher than fuel gas pressure. Alternately, a sealing diaphragm can be utilized to prevent loading air leakage.

When there is no combustion air flowing to the burner, the compression spring 22 moves the diaphragm 20 to the right, causing the combustion air nozzle valve plugs 5 and the fuel gas nozzle valve plug 10 to move to the right, closing off the combustion air and fuel gas passages. When combustion air is directed to the burner via port 1, the static pressure of the combination air is directed to the right side of the diaphragm 20 via the loading conduit 25. When the static pressure of the combustion air exceeds the force of the compression spring 22, the diaphragm 20 and, in turn, the combustion air nozzle valve plugs 5 and fuel gas nozzle valve plug 10 also move slightly to the left, partially opening the combustion air nozzle ports 4 and fuel gas nozzle port 9. With a small flow of combustion air flowing to the burner, fuel gas is turned on and the burner ignited.

If the combustion air flow to the burner is increased, the increased static pressure of the combustion air causes the diaphragm 20 to move further to the left which, in turn, causes the combustion air nozzle valve plugs 5 and the fuel gas nozzle valve plug 10 to open further, until the pressure of the loading combustion air is balanced with the pressure of the spring 22. When the maximum rated combustion air flow to the burner is reached, the combustion air nozzle ports 4 and fuel gas nozzle port 9 will be in their maximum open positions. The reverse action occurs when combustion air flow to the burner is decreased.

From the above description it can be seen that the static pressures of the burner combustion air and fuel gas will be constant, within the limits of the friction of the seals 19, the characteristics of the spring 22, and the relative diameter of the diaphragm 20. Since static pressures will be essentially constant, the velocities of the burner combustion air and fuel gas through ports 4 and 9, respectively, will also be essentially constant. By changing the areas of the combustion air and fuel gas ports automatically, in proportion to the burner firing rate, the usual problems of low velocities and low static pressures are avoided and very high turndowns can be achieved.

It will be obvious to those knowledgeable in the field that neither seal friction nor other factors that may prevent perfectly linear response of the main drive rod 13 to changes in the loading pressure on the diaphragm 20 will have little effect on air/gas ratio, since the combustion air valve plugs 5 and fuel gas valve plug 10 are moved jointly.

The preferred arrangement of the combustion air nozzle valves 5 is nine valves spaced at 40 degrees, radially, with the three connecting rods 12 spaced at 120 degrees, between the valve shafts 26. Other arrangements of combustion air valves and fuel valves; valves that are linear, rotary, or otherwise; valves that are individual or joined as one; fuel valves that are inside of air valves or vice versa; varying drive rods and connecting mechanisms may be employed without departing from the spirit of the invention.

Ports 28, located at varying radial positions between the combustion air nozzle valves 4, are used variously for visual flame observation, electronic flame detection sensor, and for a pilot burner.

Another embodiment of burner apparatus, according to the present invention is shown in FIGS. 5–8.

Reference numeral 31 designates the inlet port for combustion air. The combustion air flows in the annular space 32, formed on the outside by the burner housing 33 and on the inside by the gas tube 38, toward valve ports 34; combustion air then flows past the valve plugs 35, and into the refractory combustion chamber 36.

Fuel gas enters the burner via the inlet port 37 and flows inside the gas tube 38; passes through the fuel gas port 39 and gas valve plug 40 into the combustion chamber 36.

The fuel gas valve plug 40 is centered about and fastened to the right hand end of the fuel gas valve shaft 41. The opposite end of the fuel gas valve shaft 41 is fastened, in turn, to the center of the sealing diaphragm 42, to the center of the drive plate 43, and to the center of the power diaphragm 44. Spacers 45 and 46 serve to maintain the space between the sealing diaphragm 42, the drive plate 43, and the power diaphragm 44. The fuel gas valve shaft 41 is centered within the fuel gas tube 38 by the guide member 47 which houses the brass or bronze bearing 48. The design of the guide member 47 permits the free flow of fuel gas.

The left hand ends of the, preferred, four interconnecting rods 49 are connected to the periphery of drive plate 43. The right hand ends of the interconnecting rods 49 are fastened to the connector plate 50 which is free to slide on the outside of the fuel gas tube 38, the sliding friction being reduced by the use of the brass of bronze inserts 51.

The combustion air valve plugs 35 are centered about and fastened to the right hand ends of the combustion air valve shafts 52. The left hand ends of the combustion air valve shafts 52 are fastened to the connector plate 50.

The horizontal motion of the power diaphragm 44 causes the drive plate 43, the fuel gas valve shaft 41, the sealing diaphragm 42, the interconnecting rods 49, the connector plate 50, and the combustion air valve shafts 52 to also move horizontally.

The power diaphragm 44 is retained in the housing 53. The left side of the diaphragm 44 is loaded by the compression spring 54, retained in the housing 55. the compressive force of the spring 54 is adjusted by the threaded nut 56.

The pressure at the right hand power diaphragm chamber 57 is the same as the pressure of the combustion air in the combustion air chamber 32, the two chambers being effectively connected by the ports 58 which provide passage for the interconnecting rods 49. The righ hand power diaphragm chamber 57 is sealed around the fuel gas valve shaft 41 by the sealing diaphragm 42. The left hand power diaphragm chamber 59 is vented to atmosphere via the port 60.

When there is no combustion air flowing to the burner, the compression spring 54 moves the diaphragm 44 to the right, causing the combustion air valve plugs 35 and the fuel gas valve plug 40 to move to the right, closing off the combustion air and fuel gas passages. When the static pressure of the combustion air exceeds the force of the compression spring 54, the diaphragm 44 and, in turn, the combustion air valve plugs 35 and fuel gas valve plug 40 also move slightly to the left, partially opening the combustion air ports 34 and fuel gas port 39. With a small flow of combustion air flowing to the burner, fuel gas is turned on and the burner ignited.

If the combustion air flow to the burner is increased, the increased static pressure of the combustion air causes the diaphragm 44 to move further to the left which, in turn, causes the combustion air valve plugs 35 and the fuel gas valve plug 40 to open further, until the pressure of the loading combustion air is balanced with the pressure of the spring 54. When the maximum rated combustion air flow to the burner is reached, the combustion air ports 34 and fuel gas port 39 will be in their maximum open positions. The reverse action occurs when combustion air flow to the burner is decreased.

From the above description it can be seen that the static pressures of the burner combustion air and fuel gas will be constant, within the limits of the characteristics of the spring 54 and the relative diameter of the diaphragm 44. Since static pressures will be essentially constant, the velocities of the burner combustion air and fuel gas through ports 34 and 39, respectively, will also be essentially constant. By changing the areas of the combustion air and fuel gas ports automatically, in proportion to the burner firing rate, the usual problem of low velocities and low static pressures are avoided and very high turndowns can be achieved.

It will be obvious to those knowlegeable in the field that factors that may prevent perfectly linear response of the power diaphragm 44 to changes in the loading pressure will have no effect on air/gas ratio, since the combustion air valve plugs 35 and fuel gas valve plug 40 are moved jointly.

The preferred arrangement of the combustion air valves 35 is eight valves spaced at 45 degrees, radially, with the preferred four interconnecting rods 49 spaced at 90 degrees. Other arrangements of combustion air valves and fuel valves, valves that are linear, rotary, or otherwise, valves that are individual or joined as one, fuel valves that are inside of air valves or vice versa, varying drive rods and connecting mechanisms may be employed without departing from the spirit of the invention.

Ports 61, located at varying radial positions between the combustion air valves 34, are used variously for visual flame observation, electronic flame detection sensor, and for a pilot burner.

The radiation plate 62 and the radiation plate 63 serve to minimize the heating effect of burner flame radiation upon the sealing diaphragm 42.

Figure 10:
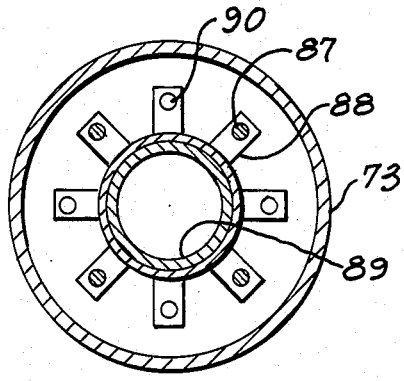
FIG. 10 is a cross-section view taken along line X—X of FIG. 9.
Figure 8:
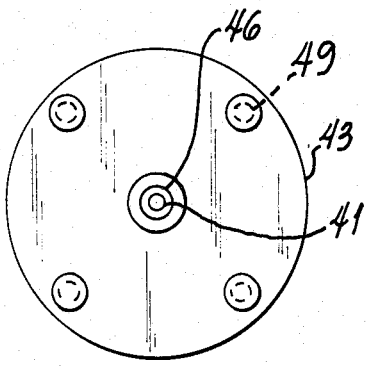
FIG. 8 is a cross-section view taken along line VIII—VIII of FIG. 5.
Figure 11:
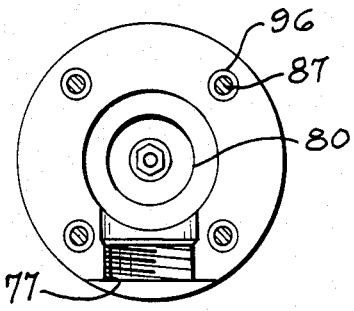
FIG. 11 is a cross-section view taken along line XI—XI of FIG. 9.
Figure 5:
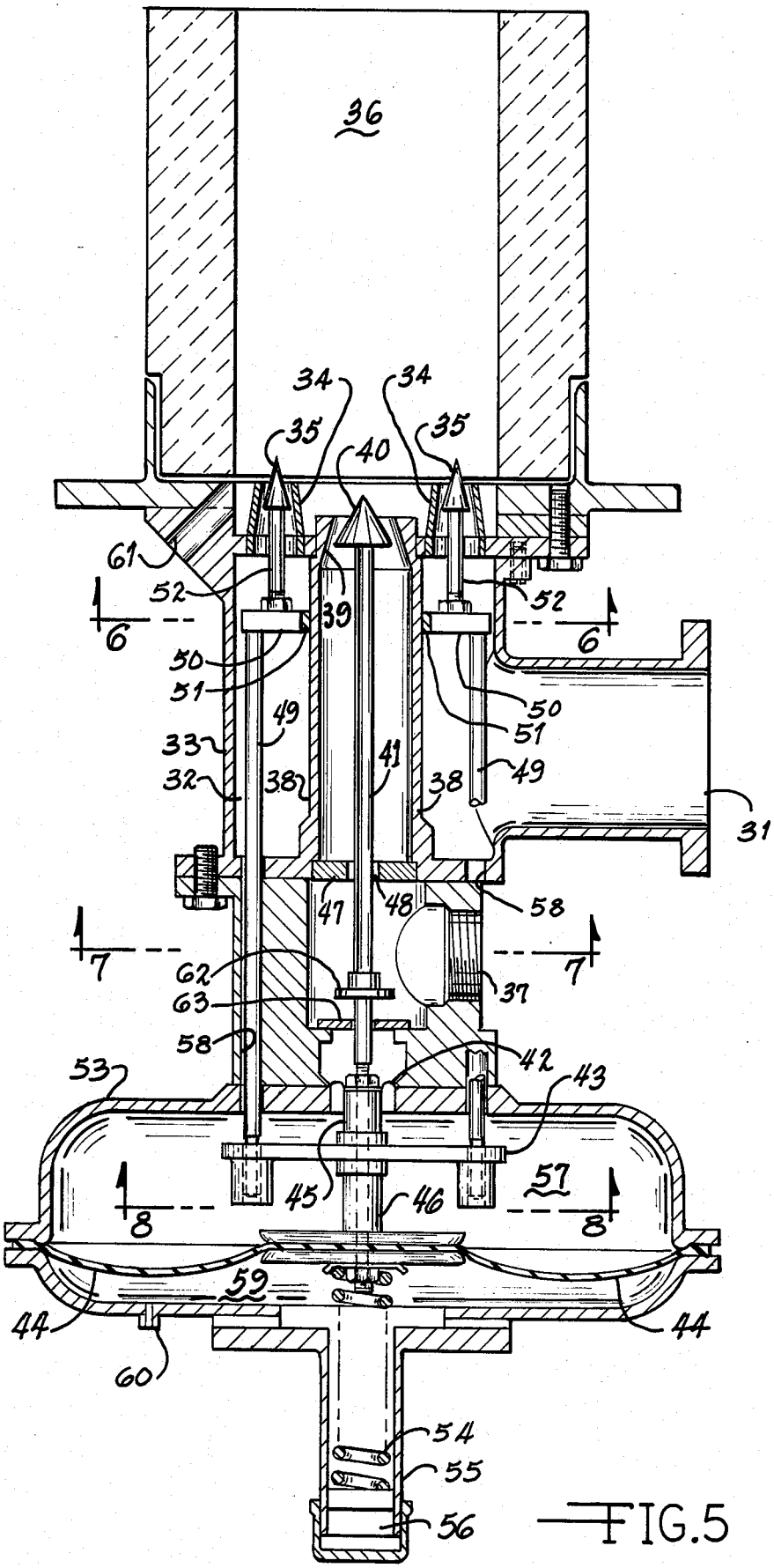
FIG. 5 is a cross-sectional view through the center of another embodiment of a constant-velocity burner in accordance with the present invention, in which certain devices "cut" by a section through the center of the burner are not shown, and in which some devices are shown out of rotational position, for the purpose of clarity.
Figure 9:
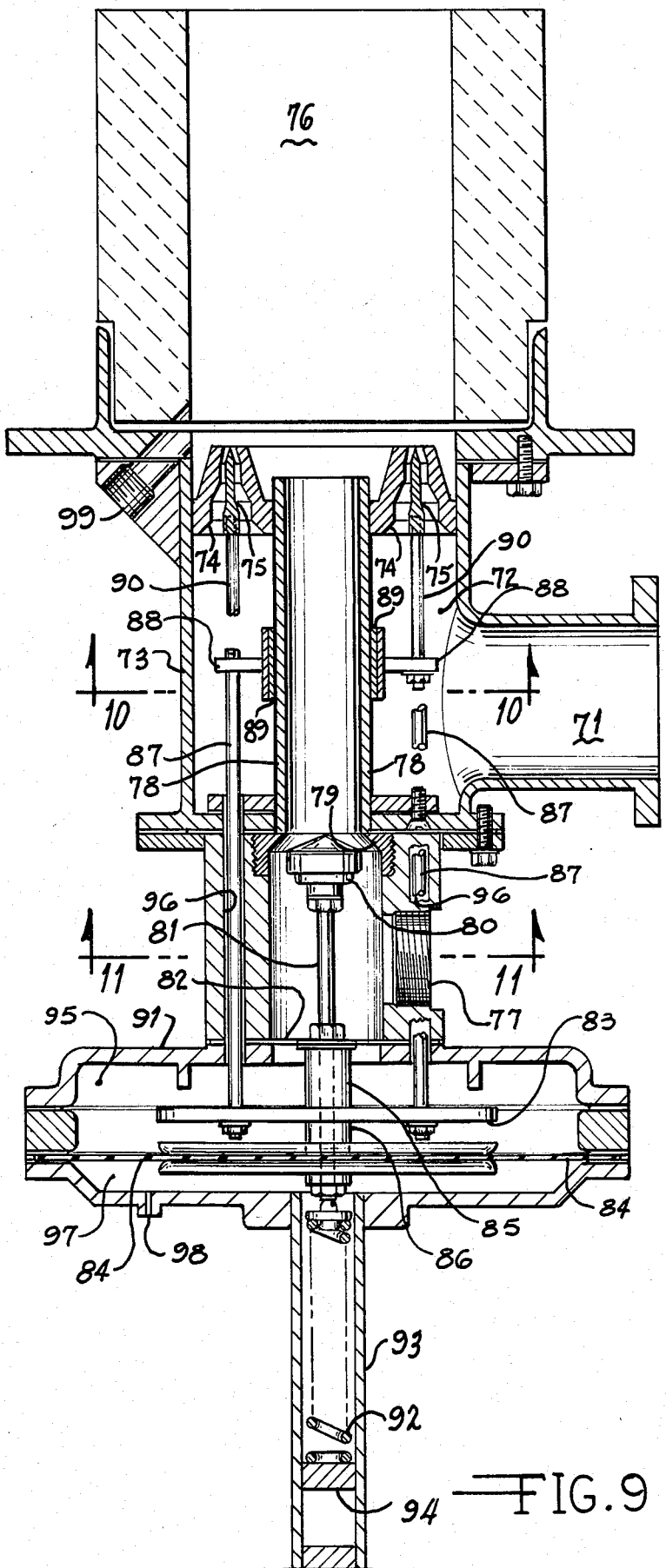
FIG. 9 is a cross-sectional view through the center of still another embodiment of a constant-velocity burner in accordance with the present invention, in which certain devices "cut" by a section through the center of the burner are not shown, and in which some devices are shown out of rotational position, for the purpose of clarity.

A still further embodiment of burner apparatus, according to the present invention is shown in FIGS. 9–11.

Reference numeral 71 designates the inlet port for combustion air. The combustion air flows in the annular space 72, formed on the outside by the burner housing 43 and on the inside by the gas tube 78, toward annular valve port 74.

Combustion air then flows past the annular valve plug 75, and into the refractory combustion chamber 76.

Fuel gas enters the burner via the inlet port 77, flows past the fuel gas port 79 and gas valve plug 80, into the gas tube 78, and into the combustion chamber 76.

The fuel gas valve plug 80 is centered about and fastened to the right hand end of the fuel gas valve shaft 81. The opposite end of the fuel gas valve shaft 81 is fastened, in turn, to the center of the sealing diaphragm 82, to the center of the drive plate 83, and to the center of the power diaphragm 84. Spacers 85 and 86 serve to maintain the space between the sealing diaphragm 82, the drive plate 83, and the power diaphragm 84.

The left hand ends of the, preferred, four interconnecting rods 87 are connected to the periphery of drive plate 83. The left hand ends of the interconnecting rods 87 are fastened to the guide assembly 88 which is free to slide on the outside of the fuel gas tube 78, the sliding friction being reduced by the use of the brass of bronze insert 89.

The combustion air valve plug 75 is centered about and fastened to the right hand ends of the, preferred, for combustion air valve shafts 90. The left hand ends of the combustion air valve shafts 90 are also fastened to the guide assembly 88.

The horizontal motion of the power diaphragm 84 causes the drive plate 83, the fuel gas valve shaft 81, the sealing diaphragm 82, the interconnecting rods 87, the guide assembly 88, and the combustion air valve shafts 90 to also move horizontally.

The power diaphragm 84 is retained in the housing 91. The left side of the diaphragm 84 is loaded by the compression spring 92, retained in the housing 93. the compressive force of the spring 92 is adjusted by the threaded nut 94.

The pressure at the right hand power diaphragm chamber 95 is the same as the pressure of the combustion air in the combustion air chamber 72, the two chambers being effectively connected by the ports 96 which provide passage for the interconnecting rods 87. The right hand power diaphragm chamber 95 is sealed around the fuel gas valve shaft 81 by the sealing diaphragm 82. The left hand power diaphragm chamber 97 is vented to atmosphere via the port 98.

When there is no combustion air flowing to the burner, the compression spring 92 moves the diaphragm 84 to the right, causing the combustion air valve plug 75 and the fuel gas valve plug 80 to move to the right, closing off the combustion air and fuel gas passages. When the static pressure of the combustion air exceeds the force of the compression spring 92, the diaphragm 84 and, in turn, the combustion air valve plug 75 and fuel gas valve plug 80 also move slightly to the left, partially opening the combustion air port 74 and fuel gas port 79. With a small flow of combustion air flowing to the burner, fuel gas is turned on and the burner ignited.

If the combustion air flow to the burner is increased, the increased static pressure of the combustion air causes the diaphragm 84 to move further to the left which, in turn, causes the combustion air valve plugs 75 and the fuel gas valve plug 80 to open further, until the pressure of the loading combustion air is balanced with the pressure of the spring 92. When the maximum rated combustion air flow to the burner is reached, the combustion air port 74 and fuel gas port 79 will be in their maximum open positions. The reverse action occurs when combustion air flow to the burner is decreased.

With the fuel gas valve 80 located upstream of the fuel gas tube 78, the velocity of the fuel gas exiting the fuel gas tube 78 is proportional to flow rate. However, the fuel gas valve 80 maintains the burner fuel gas pressure drop proportional to the burner combustion air pressure drop, so that the combustion air/fuel gas ratio to the burner can be maintained by conventional balanced pressure systems. By maintaining a constant combustion air velocity at the discharge point into the combustion chamber 76, the position of the flame front within the combustion chamber 76 is held fixed, even with varying fuel gas velocities.

Alternatively, the fuel gas port 79 and fuel gas valve 80 may be located at the discharge end of the fuel gas tube 78, in order to provide constant fuel gas velocity discharging into the combustion chamber 76.

By changing the cross-section area of the combustion air port automatically, in proportion to the burner firing rate, the usual problem of low combustion air velocities and low static pressures are avoided and very high turndowns can be achieved.

It will be obvious to those knowledgeable in the field that factors that may prevent perfectly linear response of the power diaphragm 84 to changes in the loading pressure will have no effect on air/gas ratio, since the combustion air valve plugs 75 and fuel gas valve plug 80 are moved jointly.

The preferred arrangement of the combustion air valve 75 is an annular valve centered about the gas tube 78 connected to the guide assembly 88 by four interconnecting rods 90 spaced at 90 degrees. Other arrangements of combustion air valves and fuel valves, valves that are linear, rotary, or otherwise, valves that are individual or joined as one, fuel valves that are inside of air valves or vice versa, varying drive rods and connecting mechanisms may be employed without departing from the spirit of the invention.

Ports 99, located at varying radial positions, are used variously for visual flame observation, electronic flame detection sensor, and for a pilot burner.

Having thus described my invention, what I claim as new and desire to protect by Letter Patent is:

1. An improved burner apparatus comprising, in combination, a combustion air conduit, a fuel gas conduit, a first nozzle valve means in communication with said air conduit, a second nozzle valve means in communication with said fuel gas conduit, drive means, operatively connected to both said first nozzle valve means and said second nozzle valve means, for positioning said first and second nozzle valve means in direct proportion to one another, control means operatively connected to said drive means for moving said drive means, and sensing means for communicating the pressure of the combustion air present in said combustion air conduit to said control means, whereby the drive means moves said first nozzle valve means and said second nozzle valve means jointly upon movement of said drive means.

2. An improved burner apparatus, according to claim 1, wherein said control means comprises a diaphragm means.

3. An improved burner apparatus, according to claim 1, wherein said sensing means comprises a passageway in communication with said combustio air conduit and said control means.

4. An improved burner apparatus, according to claim 1, wherein said sensing means comprises a conduit in communication with said combustion air conduit and said control means.

5. An improved burner apparatus, according to claim 1, wherein said drive means comprises a drive rod connected to said control means, said drive rod mounting a nozzle valve for controlling the rate of flow of the fuel gas.

6. An improved burner apparatus, according to claim 5, wherein said drive rod is positioned within said fuel gas conduit and mounts a fuel gas nozzle valve, a plurality of connecting rods spaced from said drive rod, intermediate members between said drive rod and said connecting rods and a plurality of combustion air nozzle valves operatively mounted by said connecting rods.

7. An improved burner apparatus, according to claim 6, wherein said plurality of combustion air nozzle valves being in communication with a plurality of combustion air ports having a frusto-conical shape, said air nozzle valves having a conical shape for seating with said combustion air ports.

8. An improved burner apparatus comprising, in combination, a combustion air conduit, a fuel gas conduit, said fuel gas conduit extending through a portion of said combustion air conduit, a central drive rod extending through said fuel gas conduit and mounting a fuel nozzle valve member at one end, a fuel nozzle port adjacent said fuel nozzle valve member, a plurality of connector rods radially spaced from said central drive rod, intermediate members extending between said central drive rod and said connector rods, a connector plate mounted by said connector rods, a plurality of shafts extending outwardly from said connector plate, said shafts mounting at least one combustion air nozzle valve member, at least one combustion air nozzle port adjacent said combustion air nozzle valve member, a diaphragm operatively connected to said central drive rod, spring means in communication with said diaphragm for urging said valve member toward a closed position and a sensing conduit between said combustion air conduit and said diaphragm, whereby a pressure change in said combustion air conduit moves said drive rod and jointly moves said fuel nozzle valve member and said combustion air nozzle valve members to maintain constant combustion air nozzle velocities and static pressures, while maintaining the ratio of combustion air and fuel gas.

9. An improved burner apparatus comprising, in combination, a combustion air chamber, a fuel gas chamber, said fuel gas chamber being positioned at least partially within said combustion air chamber, a central drive rod extending through said fuel gas chamber and mounting a fuel nozzle valve member at one end, a fuel nozzle port adjacent said fuel nozzle valve member, a drive member mounted on said central drive rod, a plurality of connector rods mounted within said combustion air chamber and operatively connected to said drive member, said connector rods mounting at least one combustion air nozzle valve member, at least one combustion air nozzle port adjacent said combustion air nozzle valve member, a diaphragm operatively connected to said central drive rod and said drive member, said drive member being operatively connected to both said fuel nozzle valve member and said combustion air nozzle valve members, spring means in communication with said diaphragm for urging said valve members toward the closed position and a sensing passageway between said combustion air chamber and said diaphragm, whereby a pressure change in said combustion air chamber moves said drive rod, and jointly moves said connector rods and said nozzle valve members to maintain constant nozzle velocities and static pressures, while maintaining the ratio of combustion air and fuel gas.

10. An improved burner apparatus, according to claim 9, including a connector plate mounted on said connector rods for sliding movement relative to said fuel gas chamber and a plurality of valve shafts extending outwardly from said connector plate, each of said shafts mounting a combustion air nozzle valve member.

11. An improved burner apparatus, according to claim 9, including a diaphragm chamber, said diaphragm and said drive member positioned within said diaphragm chamber, said sensing passageway comprising a plurality of passageways adjacent said connector rods and extending between said combustion air chamber and said diaphragm chamber.

12. An improved burner apparatus, according to claim 9, wherein a fuel gas tube is positioned adjacent said fuel nozzle port, said fuel gas tube extending away from said fuel nozzle port.

13. An improved burner apparatus, according to claim 9, wherein said combustion air nozzle valve member comprises a combustion air valve plug and said adjacent combustion air nozzle port comprises a valve port.

14. An improved burner apparatus, according to claim 12, in which fuel gas velocity discharged within said fuel gas tube varies with the fuel gas flow rate.

* * * * *